US011306999B2

(12) United States Patent
Ma et al.

(10) Patent No.: US 11,306,999 B2
(45) Date of Patent: Apr. 19, 2022

(54) POSITION ADJUSTABLE TACTICAL LIGHT STRUCTURE FOR LONG GUN

(71) Applicant: Shenzhen Olight E-Commerce Technology Co., Ltd., Guangdong (CN)

(72) Inventors: Qiang Ma, Shanxi (CN); Ziyang Zhou, Hubei (CN)

( * ) Notice: Subject to any disclaimer, the term of this patent is extended or adjusted under 35 U.S.C. 154(b) by 0 days.

(21) Appl. No.: 17/129,929

(22) Filed: Dec. 22, 2020

(65) Prior Publication Data

US 2021/0108891 A1 Apr. 15, 2021

(30) Foreign Application Priority Data

May 18, 2020 (CN) ..... 202010420294.9

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/004; F41G 11/00; F41G 11/001; F41C 27/00; F41A 23/52
See application file for complete search history.

(56) References Cited

U.S. PATENT DOCUMENTS 2,151,768 A * 3/1939 Humeston ..... F41G 11/003 42/124
2,576,007 A * 11/1951 Fischer ..... F41G 11/001 42/126
2,717,447 A * 9/1955 Leupold ..... F41G 11/001 42/127
2,857,675 A * 10/1958 Kesselring ..... F41G 11/001 42/127
3,133,353 A * 5/1964 Williams ..... F41G 1/42 42/141
3,785,603 A * 1/1974 Apel ..... F41G 11/001 248/222.13
4,860,480 A * 8/1989 Ruger ..... F41G 11/001 42/124
5,490,654 A * 2/1996 Herriman ..... F41G 11/001 248/309.1
D594,318 S * 6/2009 Fell ..... D22/110
8,171,666 B2 * 5/2012 Karagias ..... F41G 11/003 42/124
11,092,437 B1 * 8/2021 McCoy, II ..... F41G 1/54
(Continued)

*Primary Examiner* — Michelle Clement
(74) *Attorney, Agent, or Firm* — Prakash Nama; Global IP Services, PLLC

(57) ABSTRACT

This invention includes a first clamping means which comprises a base and a clamp for mounting a portable lighting apparatus; the clamp is mounted on a first end surface of the base; sliding slots are formed on two opposite side walls of the base; a second end surface of the base is provided with a groove; fixing rings, each of which comprises a connecting strip and first fixing members provided at two ends of the connecting strip; the connecting strips are mounted on the sliding slots for the base to slide on the fixing rings; a support comprising a body and a plurality of contact beads; the plurality of contact beads are mounted on the body by elastic members; a second clamping means comprising a fixing block and movable lock blocks mounted on two sides of the fixing block; the fixing block is mounted on the support.

10 Claims, 6 Drawing Sheets

(56) References Cited

U.S. PATENT DOCUMENTS

| | | | | |
|---|---|---|---|---|
| 2013/0104441 | A1* | 5/2013 | Kincel | F41G 11/004 42/90 |
| 2021/0108891 | A1* | 4/2021 | Ma | F41G 11/003 |

* cited by examiner

POSITION ADJUSTABLE TACTICAL LIGHT STRUCTURE FOR LONG GUN

BACKGROUND OF THE INVENTION

The present invention belongs to the technical field of tactical light technology and relates to a position adjustable tactical light structure for long gun.

During use of a common tactical light for long gun, when it is necessary to mount a sight on the barrel at a position on the same rail for mounting the tactical light, the tactical light would affect the line of sight. In the prior art, adjustment of the positon of the tactical light is mainly achieved by using two different types of bases. When it is necessary to mount the tactical light in middle position, use the middle base; when it is necessary to mount the tactical light on the side, use the base mounted on the side. In this way, mounting and detaching are relatively troublesome, and it is inconvenient to adjust the mounting angle; besides, other tools are required for adjusting the mounting angle of the tactical light.

BRIEF SUMMARY OF THE INVENTION

In view of the aforesaid disadvantages now present in the prior art, the present invention provides a position adjustable tactical light structure for long gun which could adjust the mounting angle of the tactical light on the firearm rail, thereby preventing the tactical light from affecting the line of sight after the tactical light is mounted on the barrel.

The present invention provides the following technical solutions:

A position adjustable tactical light structure for long gun, comprising:

- a first clamping means which comprises a base and a clamp for mounting a portable lighting apparatus; the clamp is mounted on a first end surface of the base; sliding slots are formed on two opposite side walls of the base; a second end surface of the base is provided with a groove; the first end surface and the second end surface face each other;
- fixing rings, each of which comprises a connecting strip and first fixing members provided at two ends of the connecting strip; the connecting strips are mounted on the sliding slots for the base to slide on the fixing rings;
- a support comprising a body and a plurality of contact beads; the plurality of contact beads are mounted on the body by elastic members, and the contact beads and the groove have corresponding shape and size; second fixing members are provided on end portions of the body; the first fixing members are fixedly connected with the second fixing members;
- a second clamping means for fixedly connected with a firearm rail, comprising a fixing block and movable lock blocks mounted on two sides of the fixing block; the fixing block is mounted on the support, and the fixing block is mounted on an end surface of the support which faces away from the contact beads.

Furthermore, the sliding slots are arc-shaped slots; correspondingly, the connecting strips are arc-shaped strips.

Furthermore, mounting holes are formed on the body; the contact beads are fixed to inner walls of the mounting holes through the elastic members; when the elastic members are in positions in an initial state, each of the contact beads has an exposed portion thereof exposed from the corresponding mounting hole, and the exposed portion of each of the contact beads has a volume which is smaller than or equal to half of volume of the contact bead.

Furthermore, the contact beads are disposed in a middle section of the body, and the contact beads are evenly arranged on the body.

Furthermore, the first fixing members and the second fixing members are fixedly connected by rivet connection.

Furthermore, the body of the support is in arch shape.

Furthermore, the second end surface of the base is a curved surface which is convex towards the first end surface.

Furthermore, two sides of the contact beads are each provided with a strip-shaped slot; each of the strip-shaped slots is disposed at the rivet connection between the movable lock block and the fixing block.

Furthermore, the movable lock blocks are mounted on two sides of the fixing block to form a mounting slot; the second clamping means is fixedly connected to the firearm rail through the mounting slot.

A firearm rail, wherein the firearm rail is provided with a sliding rail corresponding to the mounting slot.

The beneficial effects of the present invention are as follows:

By providing sliding slots on the base and connecting strips on the fixing rings, the base can rotate on the fixing rings. Besides, by providing the groove on the base and contact beads on the support, the groove cooperates with the contact beads to fix the base. Furthermore, fixedly connecting the contact beads with the body by the elastic members can ensure that the contact beads could enter into the groove after the base is rotated for a certain angle, thereby fixing the base. By fixedly connecting the first fixing members of the fixing rings with the second fixing members of the support, the portable lighting apparatus is limited on the base along the longitudinal direction, so that the base can only rotate on the sliding slots, thereby achieving mounting of the tactical light at different angles. By fixedly connecting the second clamping means to the support and forming a mounting slot on the second clamping means, the second clamping means could be conveniently mounted on the sliding rail of the firearm rail. Furthermore, by configuring the sliding slots as arc-shaped slots and the connecting strips as arc-shaped strips, it is more convenient to adjust the mounting angle of the tactical light. By connecting the first fixing members and the second fixing members by rivet connection, the fixing rings can be conveniently detached from the support, thus facilitating replacement of parts when the parts are damaged. By connecting the movable lock blocks and the fixing block by rivet connection, damage of the movable lock blocks due to excessive use could be prevented, and it is convenient to replace the damaged movable lock blocks. Furthermore, by providing strip-shaped slots and providing the strip-shaped slots at the rivet connections between the movable lock blocks and the fixing block, it is convenient to detach the movable lock blocks from the fixing block. By configuring the second end surface of the base as a curved surface which is convex towards the first end surface, cooperation between the contact beads and the groove could be enhanced.

References in the figures: 100—first clamping means; 110—base; 111—groove; 120—clamp; 130—sliding slot; 200—fixing ring; 210—connecting strip; 220—first fixing member; 300—support; 310—body; 311—mounting hole; 320—contact bead; 330—strip-shaped slot; 340—second fixing member; 350—elastic member; 410—fixing block; 420—movable lock block; 430—mounting slot; 500—firearm rail; 510—sliding rail; 511—strip-shaped protrusion; 600—portable lighting apparatus.

DETAILED DESCRIPTION OF THE INVENTION

An embodiment of the present invention is further described in detail below. The embodiment is illustrated in the figures. Identical or like references throughout the description and the figures represent identical or like components or components having the same or similar functions. The embodiment described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom", "inner", "outer" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "mount", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

Figure 1:
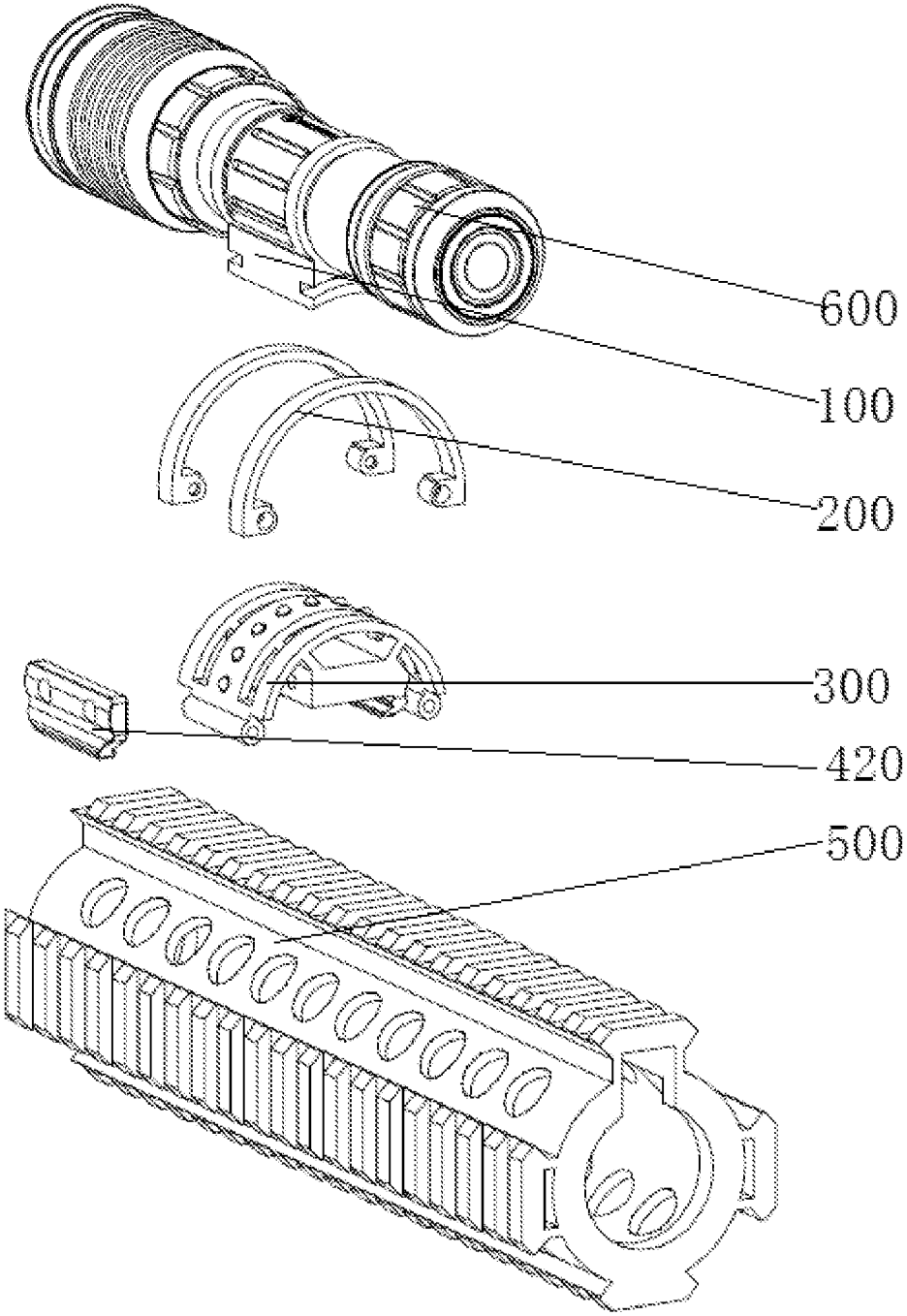
FIG. 1 is an exploded view of the present invention.

With reference to FIG. 1, a position adjustable tactical light structure for long gun comprises a first clamping means 100, fixing rings 200, a support 300 and a second clamping means. The first clamping means 100 can clamp a portable lighting apparatus 600 tightly, and the first clamping means 100 is connected to the fixing rings 200 so that the first clamping means 100 can move on the fixing rings 200. The fixing rings 200 are fixed to the support 300. The support 300 is fixed to the second clamping means so that the second clamping means can drive the portable lighting apparatus 600 to slide on the firearm rail 500.

Figure 2:
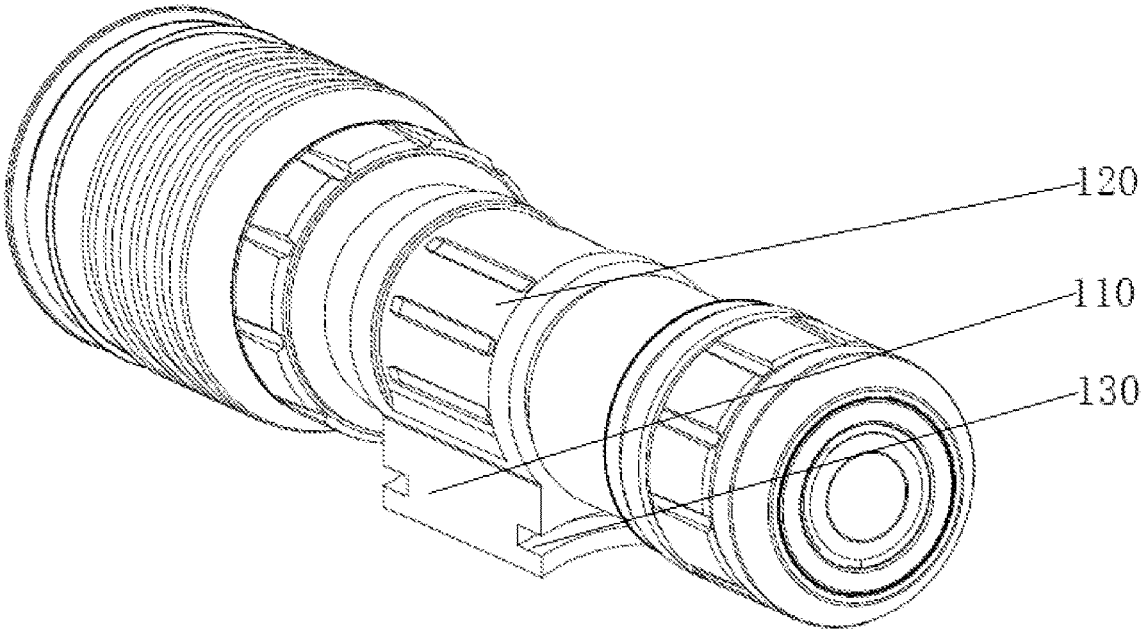
FIG. 2 is a schematic structural view of the first clamping means of the present invention.

With reference to FIG. 2, in this embodiment, the first clamping means 100 comprises a base 110 and a clamp 120. Through holes (not shown in the figures) are formed on the clamp 120 for mounting the portable lighting apparatus 600. The clamp 120 is mounted on a first end surface of the base 110. Sliding slots 130 are formed on two opposite side walls of the base 110. A second end surface of the base 110 is provided with a groove 111, and the first end surface and the second end surface face each other.

Figure 3:
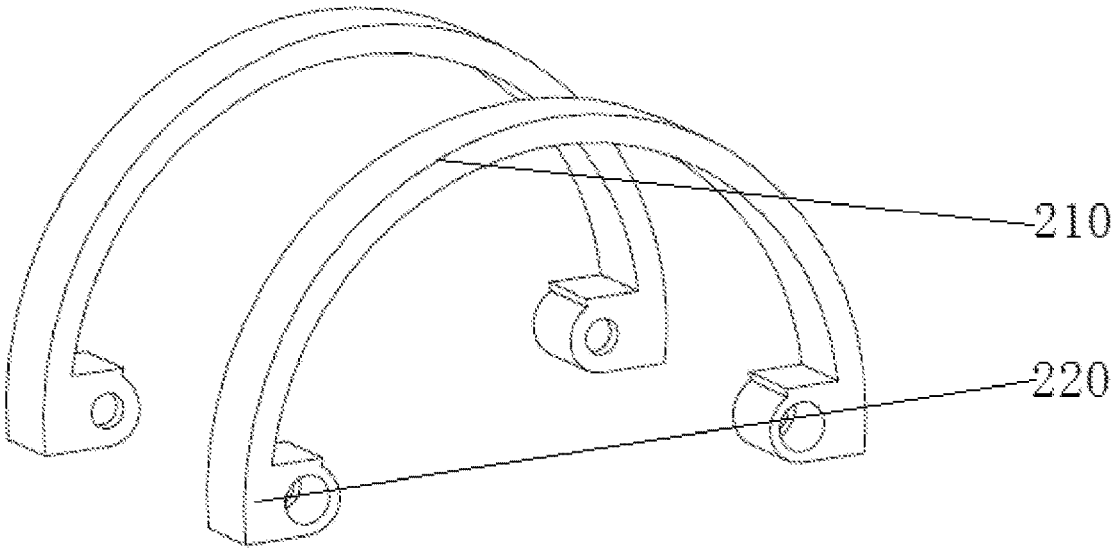
FIG. 3 is a schematic structural view of the fixing rings of the present invention.

With reference to FIG. 3, each of the fixing rings 200 comprises a connecting strip 210 and first fixing members 220 provided at two ends of the connecting strip 210. In this embodiment, the first fixing members 220 are first through holes, and the first through holes are disposed at the two ends of the connecting strip 210 so that fixing screws can pass through the through holes, thereby ensuring that the connecting strips 210 can be mounted on the sliding slots 130 for the base 110 to slide on the fixing rings 200.

In this embodiment, there is a pair of sliding slots 130, and correspondingly there is a pair of fixing rings 200. When in use, the fixing rings 200 are fixedly mounted on the base 110 by fixing screws and limit the displacement of the base 110 in a horizontal direction of the portable lighting apparatus 600, so that the base 110 can only slide in the sliding slots 130.

Figure 4:
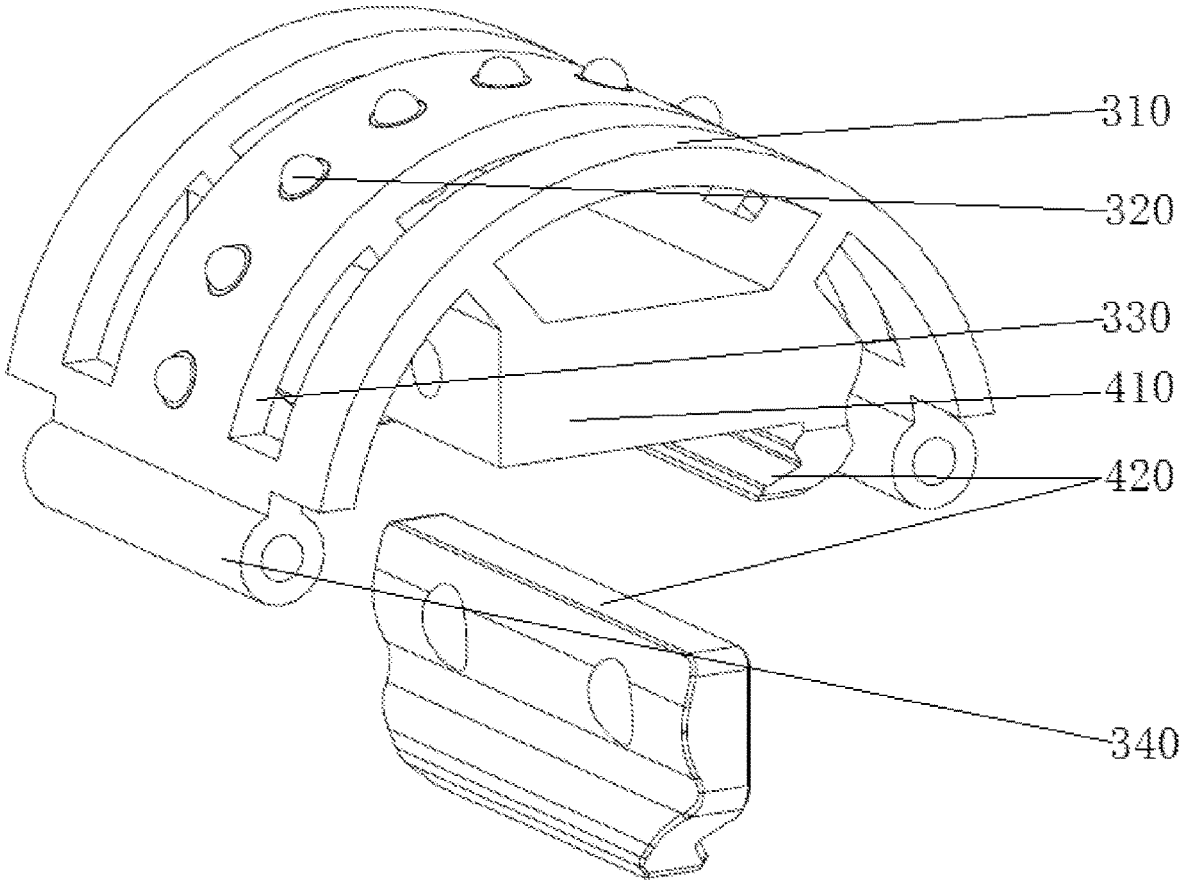
FIG. 4 is a schematic structural view of the second clamping means of the present invention.
Figure 6:
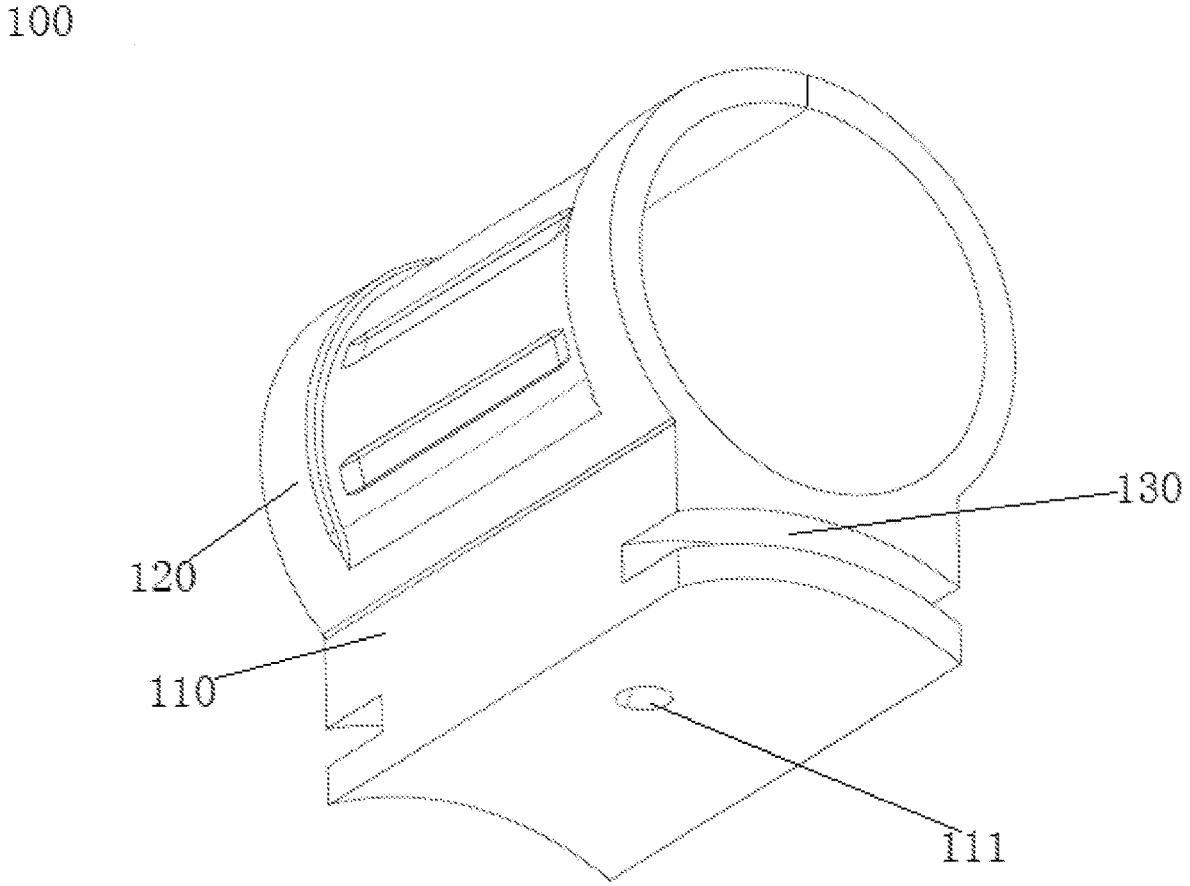
FIG. 6 is a schematic structural view of the first clamping means of the present invention.
Figure 7:
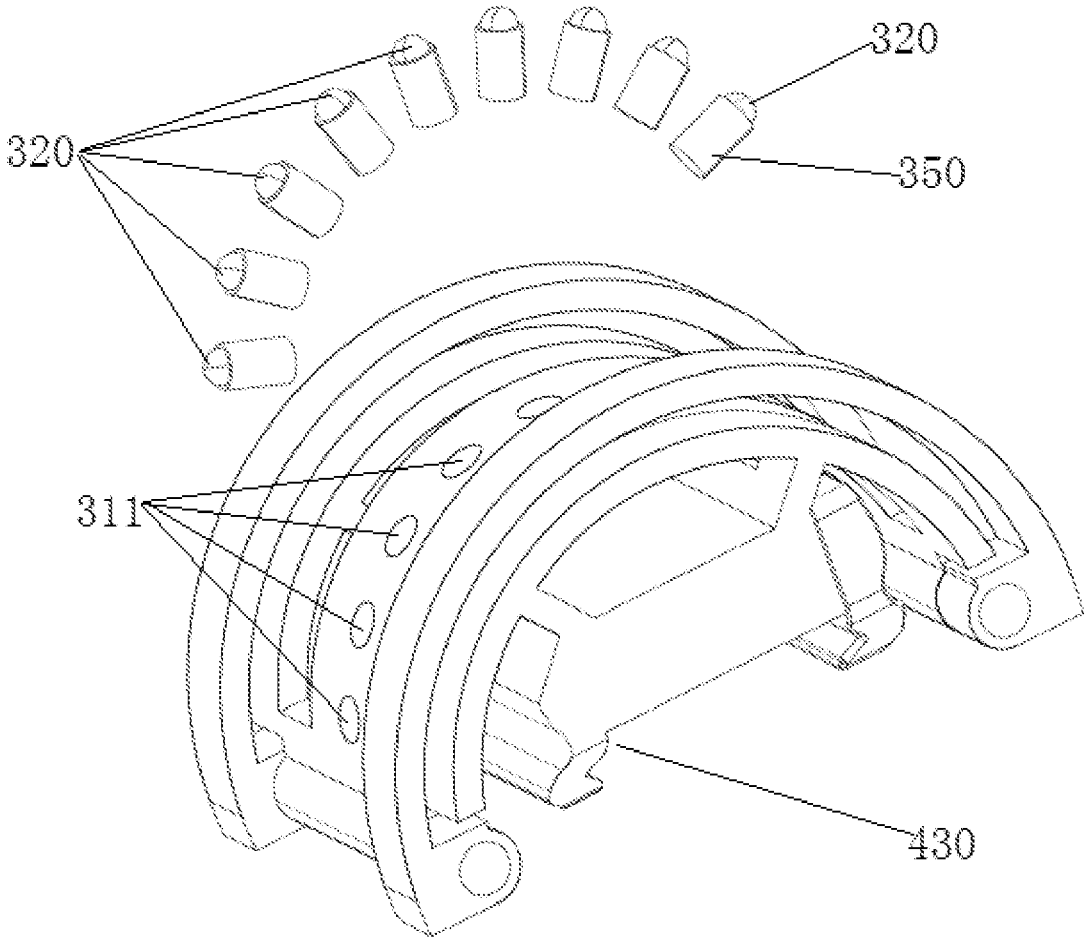
FIG. 7 is a schematic structural view showing the support as mounted on the second clamping means of the present invention.

With reference to FIGS. 4, 6 and 7, the support 300 comprises a body 310 and a plurality of contact beads 320. The plurality of contact beads 320 are mounted on the body 310 by elastic members 350, and the contact beads 320 and the groove 111 have corresponding shape and size. Second fixing members 340 are provided on end portions of the body 310. In this embodiment, the elastic members 350 are springs. Each of the springs has a first end which is connected to the body 310 and a second end which is connected to the corresponding contact bead 320. Mounting holes 311 are formed on the body 310; the contact beads 320 are fixed to inner walls of the mounting holes 311 through the elastic members 350. When the springs are in an initial state, each of the contact beads 320 has an exposed portion thereof exposed so that the contact bead 320 can be inserted into the groove 111 to fix the base 110; and the volume of the exposed portion of the contact bead 320 is smaller than or equal to half of the volume of contact bead 320, so as to facilitate adjustment of the position of base 110 on the fixing rings 200. In other embodiments, the contact beads 320 may be made by elastic material to replace the connection between the contact beads 320 and the springs to achieve this function. The second fixing members 340 are second through holes, so that ends of the fixing screws can be fixed in the second through holes to achieve fixed connection between the first fixing members 220 and the second fixing members 340. When in use, rotate the base 110 so that the bottom of the base 110 presses against the contact beads 320, thereby compressing the springs; at this time, the contact beads 320 are detached from the groove 111 so that the fixing rings 200 can slide in the sliding slots 130, thereby achieving adjustment of the mounting angle of the portable lighting apparatus 600 on the firearm rail 500.

In this embodiment, the sliding slots 130 are arc-shaped slots;

correspondingly, the connecting strips 210 are arc-shaped strips.

In this embodiment, the first fixing members 220 and the second fixing members 340 are fixedly connected by rivet connection. In this embodiment, the contact beads 320 are disposed in a middle section of the body 310. The contact beads 320 are evenly arranged on the body 310. Two sides of the contact beads 320 are each provided with a strip-shaped slot 330. Each of the strip-shaped slots 330 is disposed at the rivet connection between the movable lock block 420 and the fixing block 410. The contact beads 320 are made of elastic material. In this embodiment, the contact beads 320 are arranged in an elongated manner; correspondingly, the strip-shaped slots 330 are arranged in the same direction as the contact beads 320.

With reference to FIG. 4, the second clamping means comprises a fixing block 410 and movable lock blocks 420 mounted on two sides of the fixing block 410. The fixing block 410 is mounted on the support 300, and the fixing block 410 is mounted on an end surface of the support 300 which faces away from the contact beads 320. In this embodiment, the movable lock blocks 420 are mounted on two sides of the fixing block 410 to form a mounting slot 430, and the mounting slot 430 has a shape which is wide in middle and narrow at the opening opposite to the second end surface; correspondingly, the sliding rail 510 and the mounting slot 430 have corresponding shape so that the mounting slot 430 is fixed with the firearm rail 500, thereby achieving fixing of the second clamping means to the firearm rail 500.

In this embodiment, the body 310 of the support 300 is in arch shape; correspondingly, the second end surface of the base 110 is a curved surface which is convex towards the first end surface.

Figure 5:
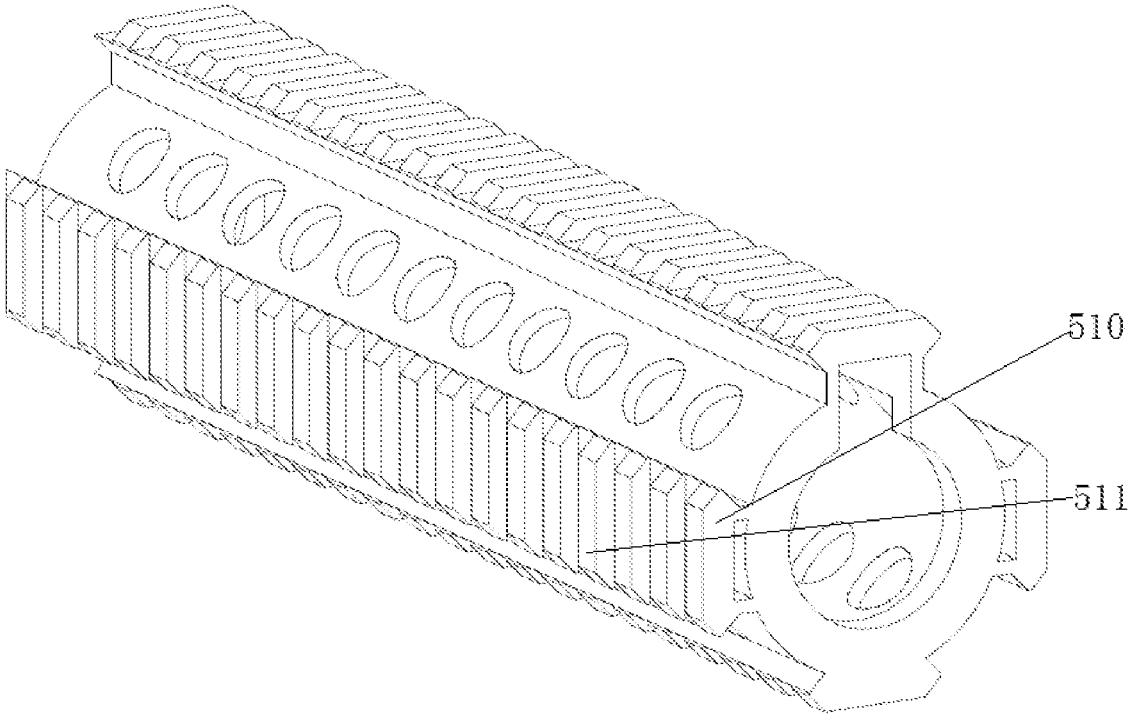
FIG. 5 is a schematic structural view of the firearm rail of the present invention.

With reference in FIG. 5, the firearm rail 500 is provided with sliding rails 510 which correspond to the mounting slot 430; strip-shaped protrusions 511 are provided on the sliding rails 510; the strip-shaped protrusions 511 are evenly distributed on the sliding rails 510.

Operation principle: When it is necessary to rotate the lighting apparatus, rotate the clamp 120 and apply a downward force to the base 110 so that the base 110 presses against the contact beads 320; the springs are then compressed; at this time, the contact beads 320 are detached from the groove 111 so that the base 110 can slide on the connecting strips 210 of the fixing rings 200. After the portable lighting apparatus 600 is rotated to the desired angle, stop applying downward force to the base 110; at this time, the contact beads 320 restore to their initial state to engage with the groove 111. The contact beads 320 limit the base 110 so that the portable lighting apparatus 600 can be fixed in position.

The description above illustrates only one of the more preferred embodiments of the present invention. Ordinary changes and replacements made within the scope of teachings of the present invention by a person skilled in the art should also fall within the scope of the present invention.

What is claimed is:

1. A position adjustable tactical light structure for long gun, comprising:

a first clamping means (100) which comprises a base (100) and a clamp (120) for mounting a portable lighting apparatus (600); the clamp (200) is mounted on a first end surface of the base (110); sliding slots (130) are formed on two opposite side walls of the base (110); a second end surface of the base (110) is provided with a groove (111); the first end surface and the second end surface face each other;

fixing rings (200), each of which comprises a connecting strip (210) and first fixing members (22) provided at two ends of the connecting strip (210); the connecting strips (210) are mounted on the sliding slots (130) for the base (110) to slide on the fixing rings (200);

a support (300) comprising a body (310) and a plurality of contact beads (320); the plurality of contact beads (320) are mounted on the body (310) by elastic members (350), and the contact beads (320) and the groove (111) have corresponding shape and size; second fixing members (340) are provided on end portions of the body (310); the first fixing members (220) are fixedly connected with the second fixing members (340);

a second clamping means for fixedly connected with a firearm rail (500), comprising a fixing block (410) and movable lock blocks (420) mounted on two sides of the fixing block (410); the fixing block (410) is mounted on the support (300), and the fixing block (410) is mounted on an end surface of the support (300) which faces away from the contact beads (320).

2. The position adjustable tactical light structure for long gun as in claim 1, wherein the sliding slots (130) are arc-shaped slots; correspondingly, the connecting strips (210) are arc-shaped strips.

3. The position adjustable tactical light structure for long gun as in claim 2, wherein mounting holes (311) are formed on the body (310); the contact beads (320) are fixed to inner walls of the mounting holes (311) through the elastic members (350); when the elastic members (350) are in positions in an initial state, each of the contact beads (320) has an exposed portion thereof exposed from the corresponding mounting hole (311), and the exposed portion of each of the contact beads (320) has a volume which is smaller than or equal to half of volume of the contact bead (320).

4. The position adjustable tactical light structure for long gun as in claim 3, wherein the contact beads (320) are disposed in a middle section of the body (310), and the contact beads (320) are evenly arranged on the body (310).

5. The position adjustable tactical light structure for long gun as in claim 4, wherein the first fixing members (220) and the second fixing members are fixedly connected by rivet connection; the movable lock blocks (420) are fixedly mounted on the fixing block (410) by rivet connection.

6. The position adjustable tactical light structure for long gun as in claim 5, wherein the body (310) of the support (300) is in arch shape.

7. The position adjustable tactical light structure for long gun as in claim 6, wherein the second end surface of the base (310) is a curved surface which is convex towards the first end surface.

8. The position adjustable tactical light structure for long gun as in claim 7, wherein two sides of the contact beads (320) are each provided with a strip-shaped slot (330); each of the strip-shaped slots (330) is disposed at the rivet connection between the movable lock block (420) and the fixing block (410).

9. The position adjustable tactical light structure for long gun as in claim 8, wherein the movable lock blocks (420) are mounted on two sides of the fixing block (410) to form a mounting slot (430); the second clamping means (400) is fixedly connected to the firearm rail (500) through the mounting slot (430).

10. A firearm rail (500) for use with the position adjustable tactical light structure for long gun as in claim 9, wherein the firearm rail (500) is provided with a sliding rail (510) corresponding to the mounting slot (430).

* * * * *